US009210513B1

(12) United States Patent
Chu et al.

(10) Patent No.: US 9,210,513 B1
(45) Date of Patent: Dec. 8, 2015

(54) MULTIPLE-RING COAXIAL AUDIO SPEAKER USING SINGLE AUDIO SOURCE

(71) Applicant: Huiyang Dongmei Audio Products Co., Ltd, Guang Dong (CN)

(72) Inventors: Ming-Chung Chu, New Taipei (TW); Taniguchi Shoichi, Nara (JP)

(73) Assignee: HUIYANG DONGMEI AUDIO PRODUCTS CO., LTD., Guang Dong (CN)

( * ) Notice: Subject to any disclaimer, the term of this patent is extended or adjusted under 35 U.S.C. 154(b) by 0 days.

(21) Appl. No.: 14/335,395

(22) Filed: Jul. 18, 2014

(51) Int. Cl.

| | |
|---|---|
| ***H04R 25/00*** | (2006.01) |
| ***H04R 9/06*** | (2006.01) |
| ***H04R 7/02*** | (2006.01) |
| ***H04R 1/28*** | (2006.01) |
| ***H04R 9/04*** | (2006.01) |
| ***H04R 9/02*** | (2006.01) |
| ***H04R 1/24*** | (2006.01) |

(52) U.S. Cl.
CPC ..... *H04R 9/063* (2013.01); *H04R 1/24* (2013.01); *H04R 1/288* (2013.01); *H04R 7/02* (2013.01); *H04R 9/025* (2013.01); *H04R 9/046* (2013.01); *H04R 2205/022* (2013.01); *H04R 2209/041* (2013.01)

(58) Field of Classification Search
CPC ..... H04R 1/24; H04R 1/26; H04R 1/288; H04R 1/403; H04R 7/02; H04R 7/122; H04R 9/025; H04R 9/046; H04R 9/063; H04R 2205/022; H04R 2205/026; H04R 2209/041
USPC ..... 381/300, 335, 337, 339, 182, 186, 396, 381/398, 401, 402, 423, 432; 181/144, 145, 181/147, 199
See application file for complete search history.

(56) References Cited

U.S. PATENT DOCUMENTS

| | | | | | |
|---|---|---|---|---|---|
| 4,122,315 | A | * | 10/1978 | Schroeder et al. | 381/186 |
| 5,339,286 | A | * | 8/1994 | Esposto | 367/140 |
| 5,604,815 | A | * | 2/1997 | Paddock | 381/396 |

* cited by examiner

*Primary Examiner* — Huyen D Le
(74) *Attorney, Agent, or Firm* — Muncy, Geissler, Olds & Lowe, P.C.

(57) ABSTRACT

A disclosed multi-ring coaxial audio speaker may include a treble sound unit, a first bass sound unit co-axially surrounding the treble sound unit, and a second bass sound unit co-axially surrounding the first bass sound unit. The first bass sound unit, the second bass sound unit, and the treble sound unit may be co-axially disposed with respect to each other. Bass vibration audio source points and a treble vibration audio source point may be at the same horizontal level, to achieve the broader electrical adjustability. The size of the audio speaker may be reduced as well.

14 Claims, 16 Drawing Sheets

MULTIPLE-RING COAXIAL AUDIO SPEAKER USING SINGLE AUDIO SOURCE

BACKGROUND

1. Technical Field

The present disclosure relates to an audio speaker, in particular, to a multiple-ring coaxial audio speaker using a single audio source. Specially, the audio speaker employs multiple bass sound units and a treble sound unit surrounded by the bass sound units, with the bass sound units and the treble sound unit co-axially disposed. Further, vibration audio source points of the bass sound units and a vibration audio source point of the treble sound unit may be aligned at the same horizontal level. As such, the bass sound units and the treble sound unit may operate at the same time.

2. Description of Related Art

Traditional earphones or audio speakers are equipped with one single amplifier (sound unit) and that renders difficult the realization of a broad range of listening experience. And certain tradeoff becomes necessary if the bass performance needs to be enhanced (at the expense of the treble performance). Even for achieving the goal of the above mentioned broad listening experience, multiple separate sound units (for example, distinct treble sound unit and bass sound unit) need to be placed within the earphones or the audio speakers, occupying additional space inside the earphones or the audio speakers and inevitably increasing the size of the same.

SUMMARY OF THE DISCLOSURE

In order to overcome the aforementioned deficiency, the present disclosure provides a multi-ring coaxial audio speaker using a single audio source. The disclosed audio speaker may have multiple bass sound units co-axially surround the treble sound unit and the vibration audio source points of the bass sound units at the same horizontal level with the vibration source point of the treble sound unit. Consequently, the size of the audio speaker may be reduced and such audio speaker may be associated with the broader range of electrical adjustability.

A multi-ring coaxial audio speaker according to one embodiment of the present disclosure may include a treble sound unit having the sound thereof to be channeled out through a treble sound hole. The treble sound unit may also include a treble vibration audio source point and a treble wiring board. The disclosed audio speaker may further include a first bass sound unit having a first positional space, a first vibrating vocal tone diaphragm, and a first bass wiring board. The first bass sound unit may be associated with a first bass vibration audio source point. The audio speaker may further include a second bass sound unit having a second positional space, a second vibrating vocal tone diaphragm, and a second bass wiring board. The second bass sound unit may be associated with a second bass vibration audio source point. The first bass sound unit is co-axially disposed with the second bass sound unit and positioned within the second positional space, and the treble sound unit is co-axially disposed with the first bass sound unit and positioned within the first positional space. The first bass sound unit, the second bass sound unit, and the treble sound unit are co-axially disposed and the first bass vibration audio source point, the second bass vibration audio source point, and the treble vibration audio source point are at the same horizontal level.

Specifically, the treble sound unit is a circular electromagnetic sound unit, a rectangular electromagnetic moving iron sound unit, a moving-vocal coil sound unit, a ribbon-type sound unit, a piezo-ceramic sound piece component, a piezo-ceramic sound piece adjoining another vibrating vocal tone diaphragm, or a semiconductor chip sound unit.

Specifically, a first magnetic resistant ring may be disposed at the position where the co-axially disposed first bass sound unit and the second bass sound unit adjoin, for separating a magnetic field of the first bass sound unit and a magnetic field of the second bass sound unit.

Specifically, a second magnetic resistant ring may be disposed at the position where the co-axially disposed first bass sound unit and the treble sound unit adjoin, for separating a magnetic field of the first bass sound unit and a magnetic field of the treble sound unit.

Specifically, the first bass sound unit or the second bass sound unit may further include: a ring-shaped magnetic-conductive base with a center portion of the magnetic-conductive base defining a hollow positional space, and a main body of the ring-shaped magnetic-conductive base defining an accommodating space with a top opening. The main body includes an inner ring wall and an outer ring wall defining the top opening. The first bass sound unit and the second bass sound unit may also include a first ring-shaped magnet and a second ring-shaped magnet, respectively. The first ring-shaped magnet may be positioned and attached at the inner ring wall, the second ring-shaped magnet may be positioned and attached at the outer ring wall, and the first ring-shaped magnet and the second ring-shaped magnet may define a magnetic gap therebetween. The first bass sound unit and the second bass sound unit may also include a first magnetic-conductive ring and a second magnetic-conductive ring, respectively. The first magnetic-conductive ring may be disposed on a top surface of the first ring-shaped magnet, and the second magnetic-conductive ring may be disposed on a top surface of the second ring-shaped magnet. The first bass sound unit or the second bass sound unit may also include a vibrating vocal tone diaphragm having a ring-shaped diaphragm membrane, an external pressurized frame positioned at an outer ring edge of the ring-shaped diaphragm membrane and connected to an end of the outer ring wall of the ring-shaped magnetic conductive base, and an internal pressurized frame positioned at an inner ring edge of the ring-shaped diaphragm membrane and connected to an end of the inner ring wall of the ring-shaped magnetic conductive base. The ring-shaped magnetic conductive base may be enclosed at the top opening as the result. A vocal coil may be connected to a bottom of the ring-shaped diaphragm membrane. The position where the vocal coil and the diaphragm membrane connect may define a vibration audio source point. And the vocal coil may extend into the magnetic gap. The first bass sound unit or the second bass sound unit may include a wiring board adjoined on an external wall of a bottom surface of the magnetic-conductive base for positioning wires of the vocal coil.

Specifically, a flow damping gauze may be adhesively attached on the external wall of the bottom surface of the magnetic-conductive base for covering a vent hole and adjusting an air flow within the positional space, a first dust cover may be above the first bass sound unit and the treble sound unit allowing for the sound of the first bass sound unit to be transmitted out of a first bass sound hole of the first dust cover, and a second dust cover may be above the second bass sound unit allowing for the sound of the second bass sound unit to be transmitted out of a second sound hole of the second dust cover. The treble sound unit may be associated with a treble sound hole allowing for the sound from the treble sound unit to be transmitted out of the treble sound hole.

Specifically, the first bass sound unit or the second bass sound unit may further include a ring-shaped magnetic-conductive base with a center portion of the magnetic-conductive base defining a hollow positional space, and a main body of the ring-shaped magnetic-conductive base defining an accommodating space with a top opening. The main body may include an inner ring wall and an outer ring wall defining the top opening. The first bass sound unit or the second bass sound unit may include a ring-shaped magnet positioned and attached at the inner ring wall, and the second ring-shaped magnet positioned between the outer ring wall and the inner ring wall. The placement of the first ring-shaped magnet and the second ring-shaped magnet may define the positional space into a first magnetic gap and a second magnetic gap. Either the first bass sound unit or the second bass sound unit may include a magnetic-conductive ring disposed on a top surface of the ring-shaped magnet, a vibrating vocal tone diaphragm having a ring-shaped diaphragm membrane, an external pressurized frame positioned at an outer ring edge of the ring-shaped diaphragm membrane and connected to an end of the outer ring wall of the ring-shaped magnetic conductive base, and an internal pressurized frame positioned at an inner ring edge of the ring-shaped diaphragm membrane and connected to an end of the inner ring wall of the ring-shaped magnetic conductive base. A first vocal coil may be connected to the inner ring edge, a first vibration audio source point may be formed at the position where the first vocal coil and the inner ring edge connect, a second vocal coil may be connected to the outer ring edge, a second vibration audio source point may be formed at the position where the second vocal coil and the outer ring edge connect, the vibrating vocal tone diaphragm may be integrated and stationed around the top opening of the ring-shaped magnetic-conductive base, the diaphragm membrane may be positioned at the top opening of the positional space and enclose the top opening. The first vocal coil may extend into the first magnetic gap, and the second vocal coil may extend into the second magnetic gap, for the magnet to be positioned between the first vocal coil and the second vocal coil. The first bass sound unit or the second bass sound unit may include a wiring board adjoined on an external wall of a bottom surface of the magnetic-conductive base for positioning wires of the first vocal coil and the second vocal coil.

Specifically, a flow damping gauze may be adhesively attached on the external wall of the bottom surface of the magnetic-conductive base for covering a vent hole and adjusting an air flow within the positional space, a first dust cover may be above the first bass sound unit and the treble sound unit allowing for the sound of the first bass sound unit to be transmitted out of a first bass sound hole of the first dust cover, and a second dust cover may be above the second bass sound unit allowing for the sound of the second bass sound unit to be transmitted out of a second sound hole of the second dust cover. The treble sound unit may be associated with a treble sound hole allowing for the sound from the treble sound unit to be transmitted out of the treble sound hole.

Specifically, the first bass sound unit or the second bass sound unit may further include a ring-shaped magnetic-conductive base with a center portion of the magnetic-conductive base defining a hollow positional space, and a main body of the ring-shaped magnetic-conductive base having an auxiliary magnetic adjoining space and a coil movement space separated from the auxiliary magnetic adjoining space by a separating wall. Plus, the first bass sound unit or the second bass sound unit may include a ring-shaped magnet having a first surface and a second surface opposite to the first surface, with either the first surface or the second surface located within the coil movement space, and the ring-shaped magnet positioned within the coil movement space and away from the separating wall, to form a magnetic gap between the ring-shaped magnet and the separating wall. The first bass sound unit or the second bass sound unit may include a magnetic-conductive ring disposed on either the first surface or the second surface not within the coil movement space, defining a top opening between the ring-shaped magnetic ring and the magnetic-conductive base, and a vibrating vocal tone diaphragm having a ring-shaped diaphragm membrane on which a vocal coil is connected. The position where the vocal coil and the diaphragm membrane connect may form a bass vibration audio source point, the vibrating vocal tone diaphragm may be positioned around the top opening defined by the magnetic-conductive base and the magnetic-conductive ring to enclose the top opening, and the vocal coil may extend into the coil movement space and positioned within the magnetic gap within the coil movement space. The first bass sound unit or the second bass sound unit may include a wiring board adjoined on an external wall of a bottom surface of the magnetic-conductive base for positioning wires of the vocal coil.

Specifically, the auxiliary magnetic adjoining space is in the proximity of the positional space while the coil movement space is away from positional space.

Specifically, an auxiliary magnet is within the auxiliary magnetic adjoining space.

Specifically, the coil movement space is in the proximity of the positional space while the auxiliary magnetic adjoining space is away from positional space.

Specifically, an auxiliary magnet is within the auxiliary magnetic adjoining space.

For further understanding of the present disclosure, reference is made to the following detailed description illustrating the embodiments and examples of the present disclosure. The description is only for illustrating the present disclosure, not for limiting the scope of the claim.

BRIEF DESCRIPTION OF THE DRAWINGS

The drawings included herein provide further understanding of the present disclosure. A brief introduction of the drawings is as follows.

DESCRIPTION OF THE EXEMPLARY EMBODIMENTS

The aforementioned and other technical contents, features, and efficacies will be shown in the following detail descriptions of a preferred embodiment corresponding with the reference Figures.

Figure 1:
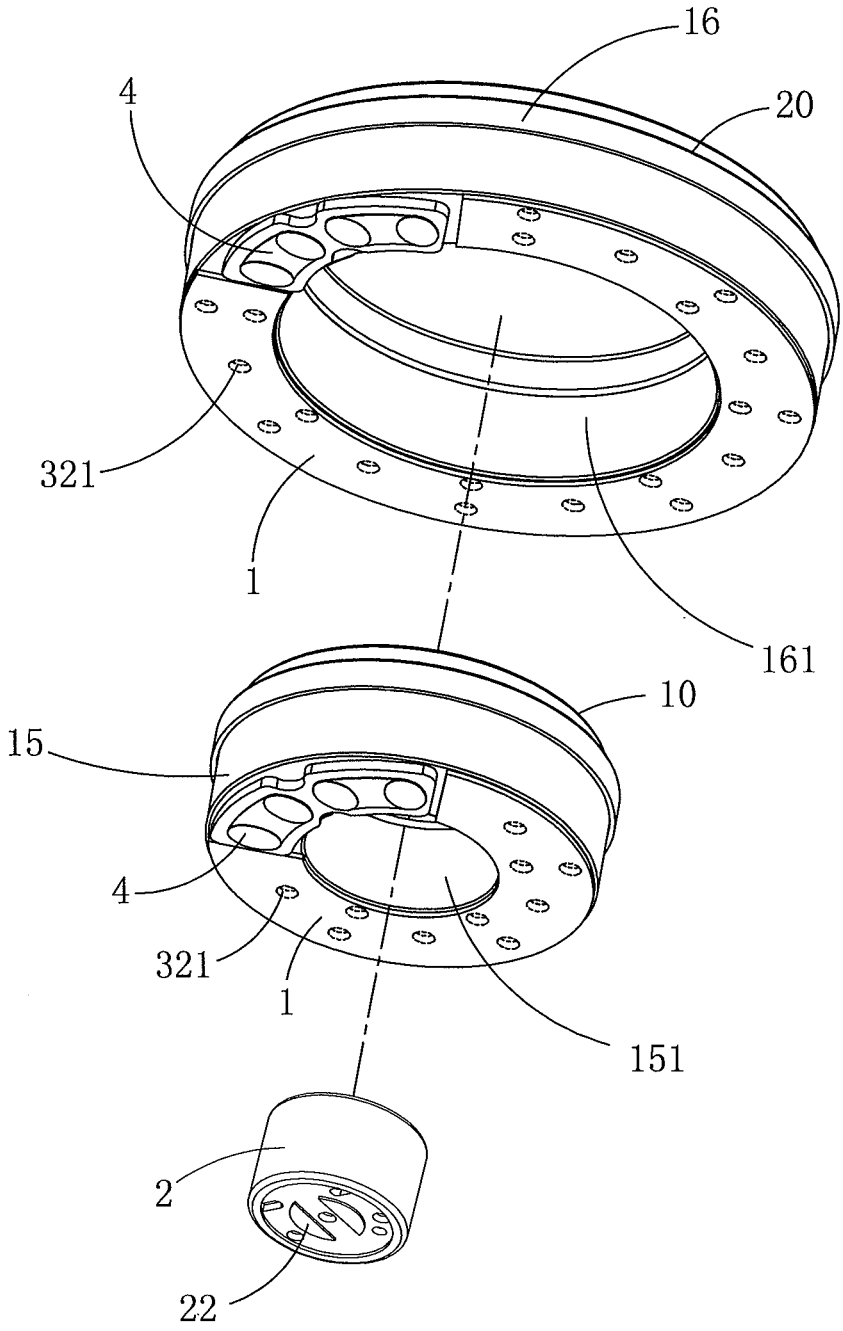
FIG. 1 shows an exploded view of a multi-ring coaxial audio speaker according to one embodiment of the present disclosure.
Figure 2:
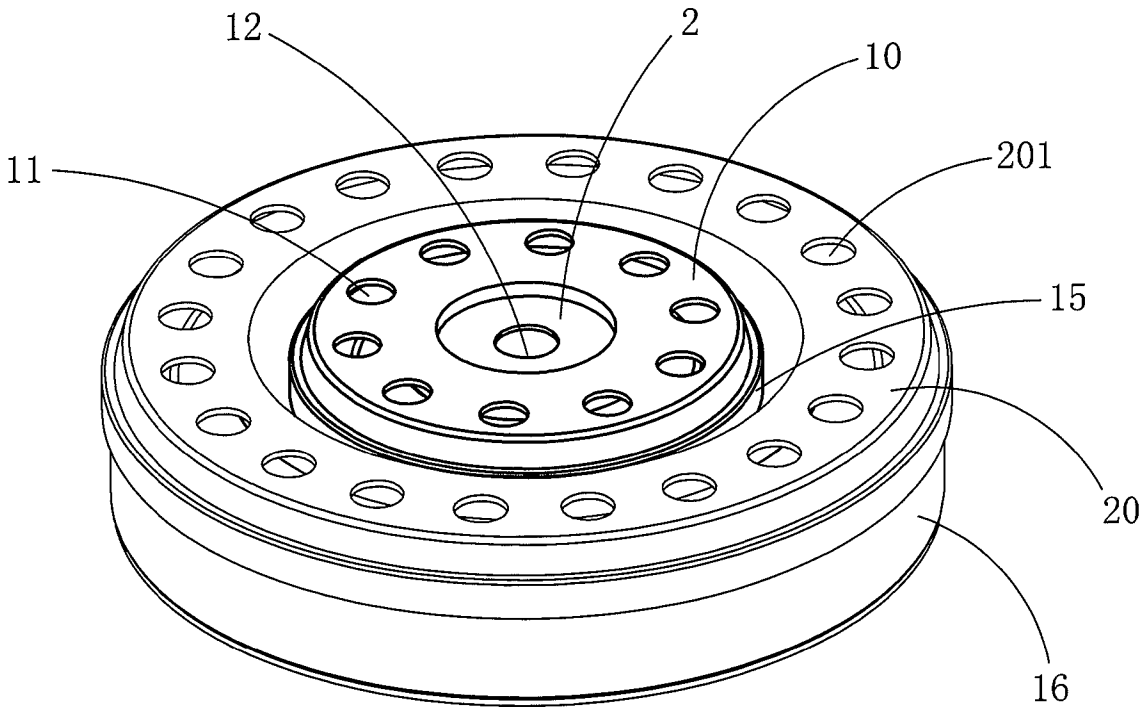
FIG. 2 shows a front view of the audio speaker in FIG. 1 according to one embodiment of the present disclosure.
Figure 3:
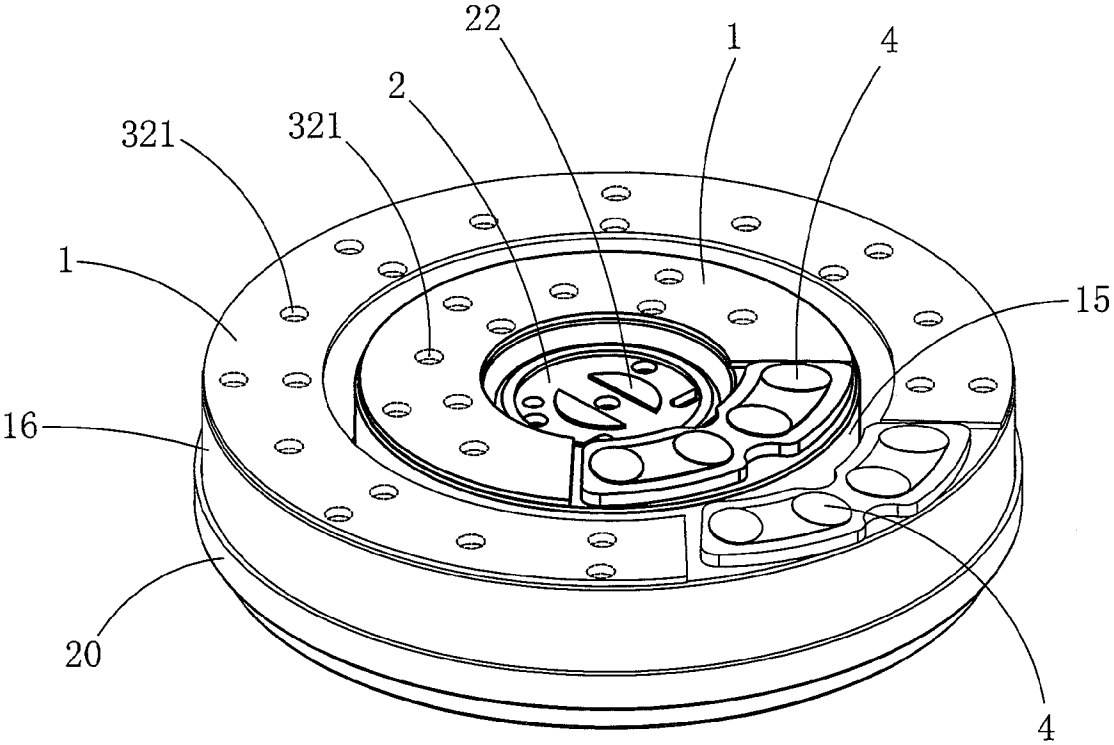
FIG. 3 shows a back view of the audio speaker in FIG. 1 according to one embodiment of the present disclosure.

Please refer to FIGS. 1-3 illustrating multi-ring coaxial audio speakers using a single audio source according to embodiments of the present disclosure. The audio speaker may include multiple bass sound units 100 and a treble sound unit 2. The disclosure in below use two bass sound units for the illustration, and is not limited as the result. In other words, the present disclosure could cover the embodiments with more than two bass sound units.

The audio speaker may include a first bass sound unit 15 and a second bass sound unit 16. The center portion of the first bass sound unit 15 and the second bass sound unit 16 may define hollow positional space 151 and 161, respectively. The first bass sound unit 15 may be co-axially disposed with the second bass sound unit 16 and placed within the second positional space 161. Meanwhile, the treble sound unit 2 and the first bass sound unit 15 may be co-axially disposed as well. And the treble sound unit 2 may be placed within the first positional space 151. The treble sound unit 2, the first bass sound unit 15, and the second bass sound unit 16 may be co-axially disposed.

Figure 4:
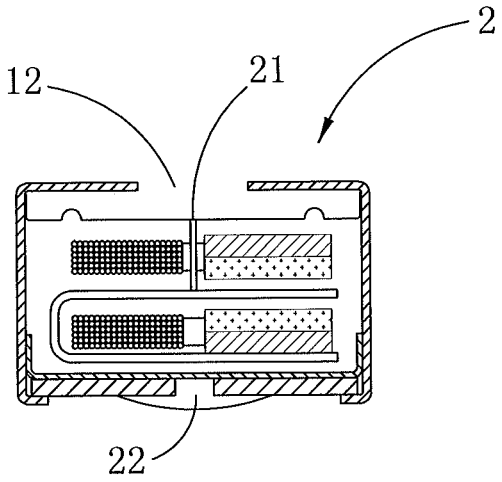
FIGS. 4, and 4A-4F show a treble sound unit of the audio speaker according to one embodiment of the present disclosure.
Figure 4A:
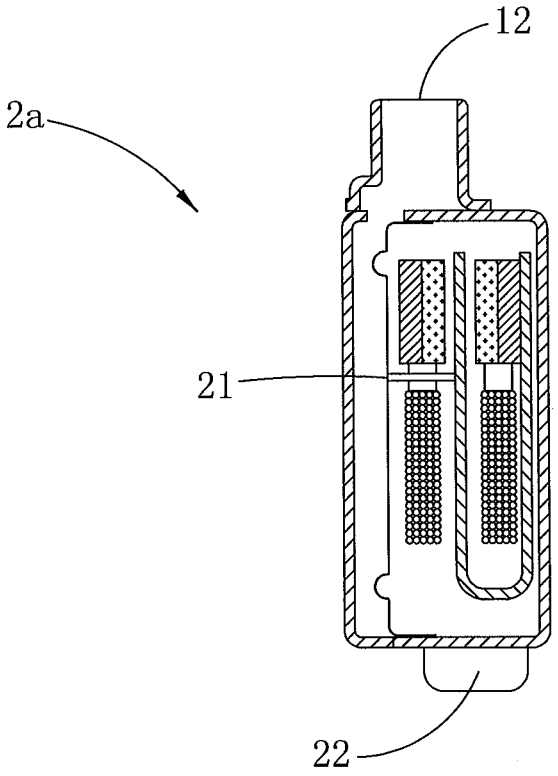
Figure 4B:
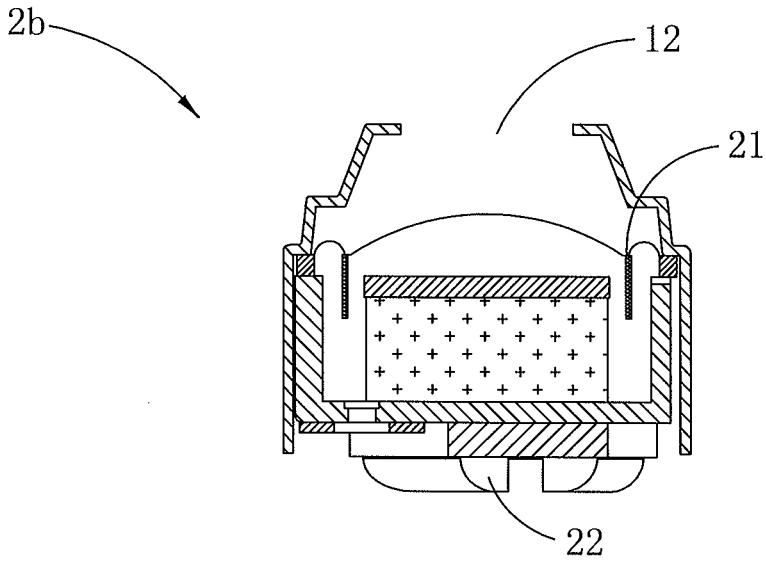
Figure 4C:
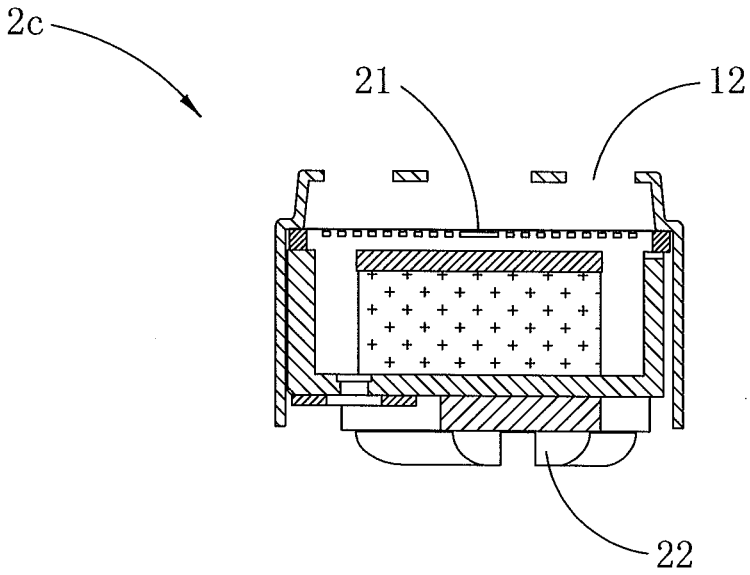
Figure 4D:
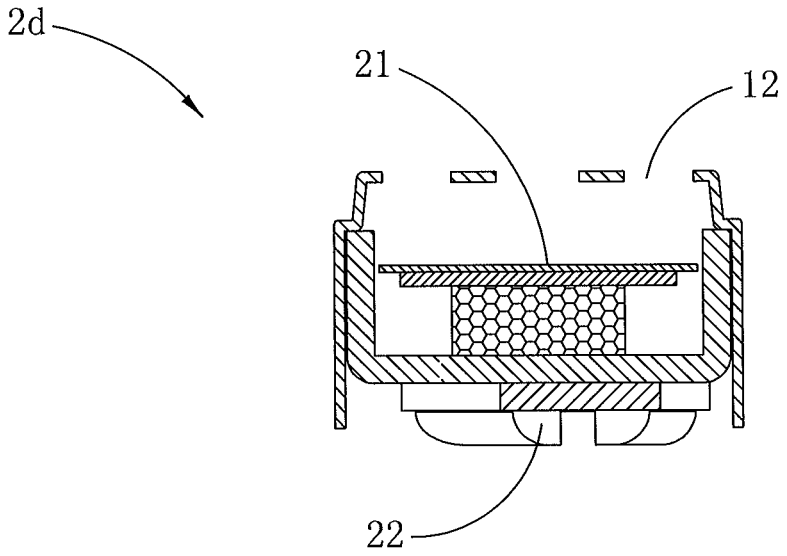
Figure 4E:
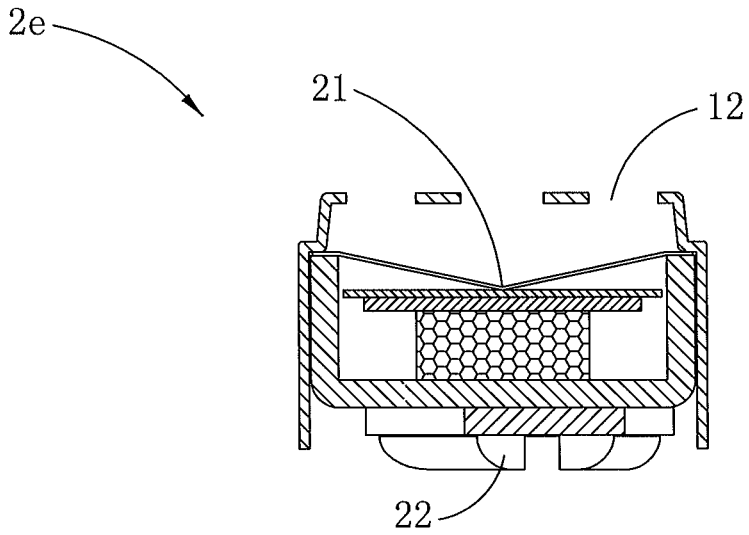
Figure 4F:
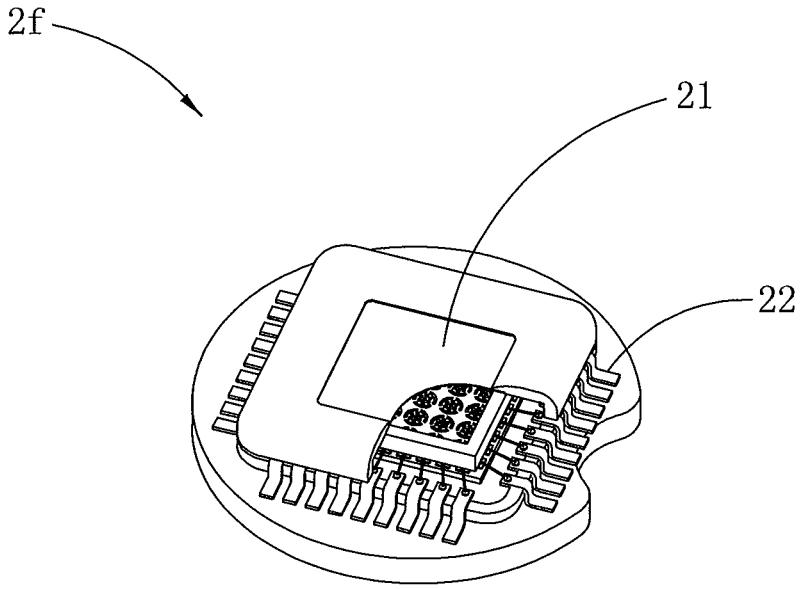

Please refer to FIG. 4 showing the treble sound unit 2. In one implementation, the treble sound unit 2 may be a circular electromagnetic moving iron treble sound unit. The treble sound unit 2 may include a treble vibration audio source point 21 and a wiring board 22 at the bottom of the treble sound unit 2. A treble sound hole 12 may be disposed allowing for the sound from the treble sound unit 2 to be transmitted out. As illustrated in FIGS. 4A-4F, the treble sound unit may be a rectangular electromagnetic moving iron sound unit 2*a* (FIG. 4A), a moving coil sound unit 2*b* (FIG. 4B), a ribbon-type sound unit 2*c* (FIG. 4C), piezo-ceramic sound piece components 2*d* (FIG. 4D), a piezo-ceramic sound piece adjoining another vibrating vocal tone diaphragm 2*e* (FIG. 4E), or a semiconductor chip sound unit 2*f* (FIG. 4F). The treble sound units in FIGS. 4A-4E may include both the treble wiring boards 22 and the treble vibration audio source points 21. Except for the semiconductor chip sound unit 2*f*, which may not be with the treble sound hole, other treble sound unit embodiments may be with their respective treble sound holes 12. It is worth noting that the treble sound units discussed in above are just for the illustration purpose and are not intended to limit the scope of the present disclosure.

Figure 5:
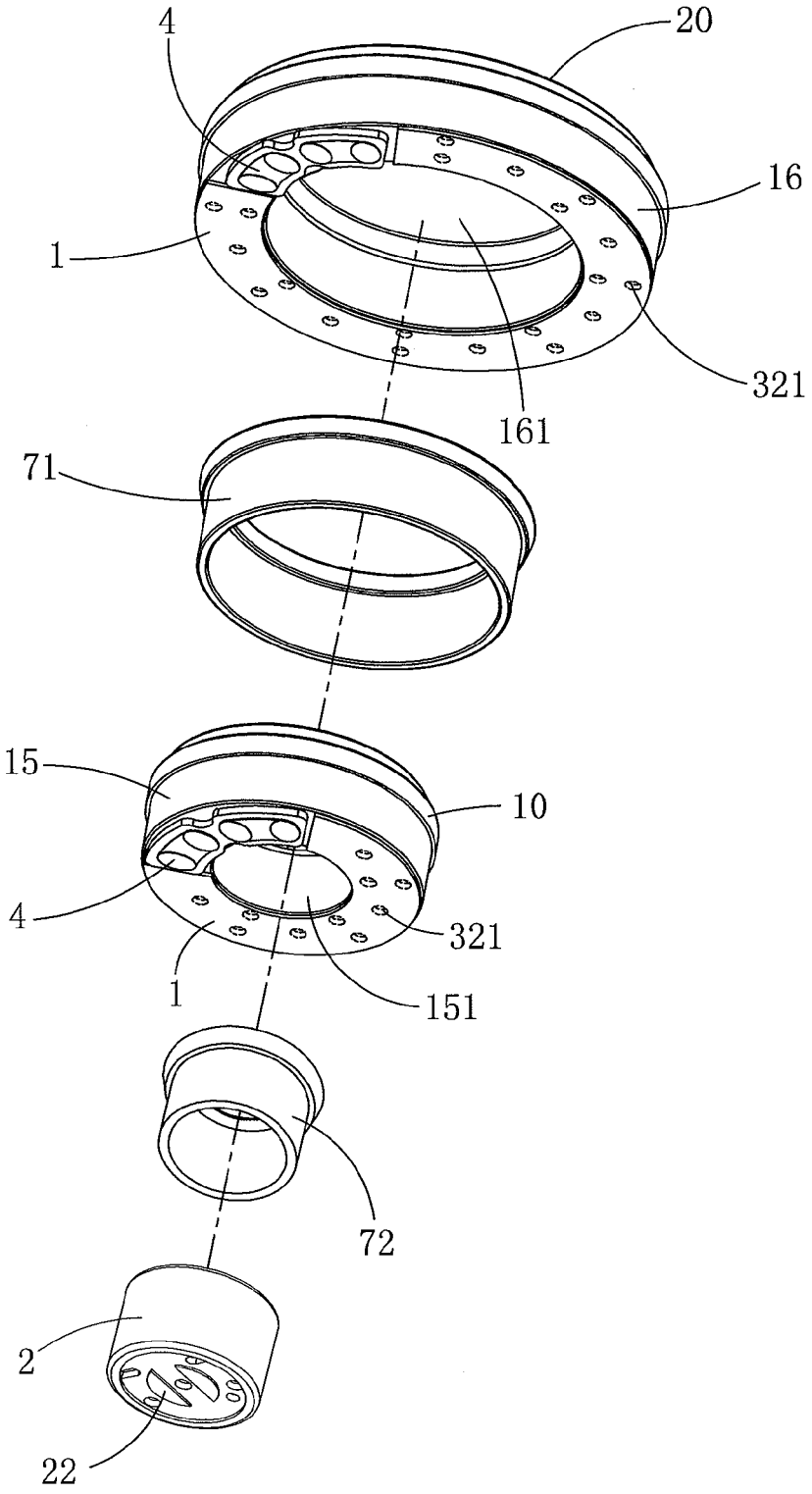
FIG. 5 is an exploded view of another audio speaker according to one embodiment of the present disclosure.
Figure 6:
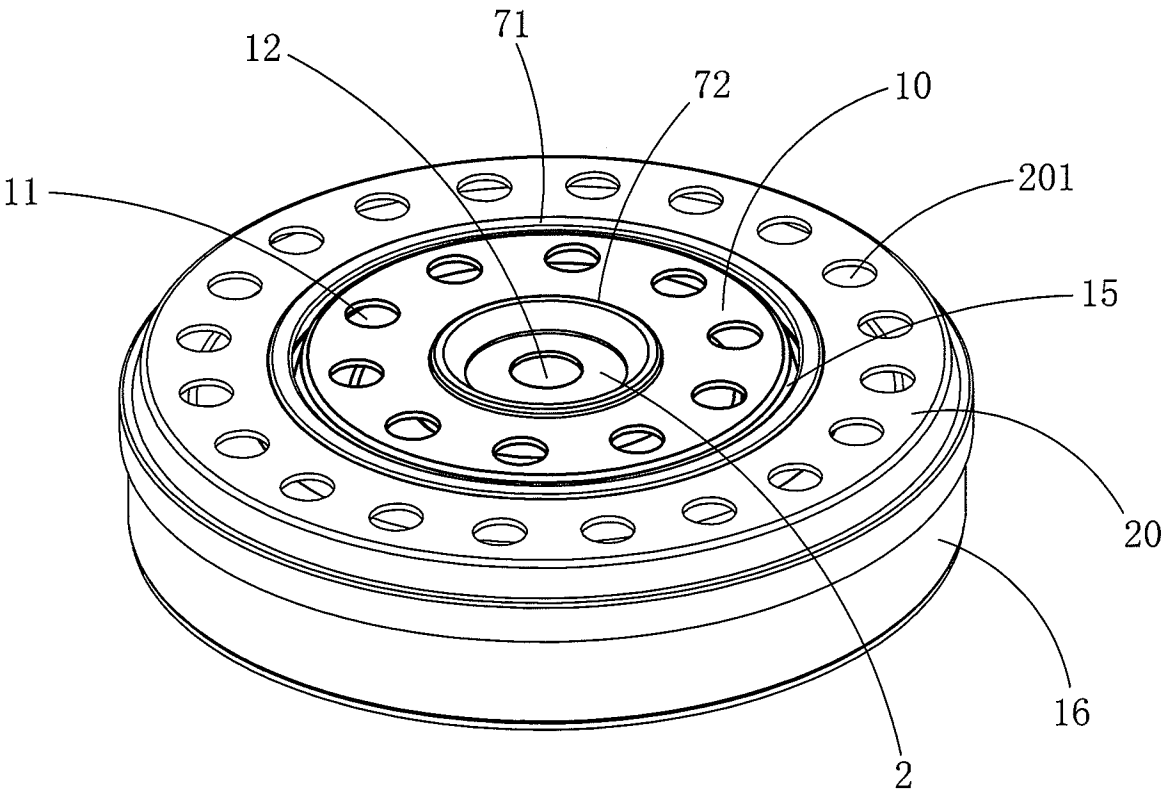
FIG. 6 is a front view of the audio speaker in FIG. 5 according to one embodiment of the present disclosure.
Figure 7:
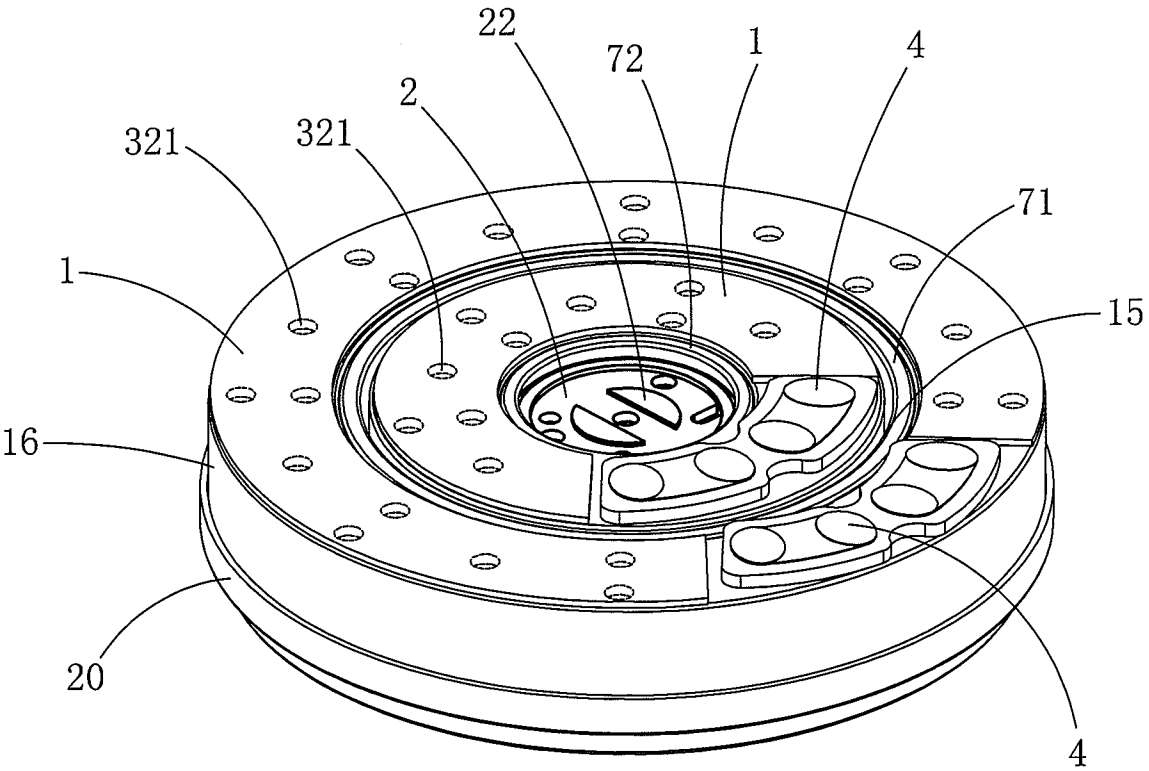
FIG. 7 is a back view of the audio speaker in FIG. 5 according to one embodiment of the present disclosure.
Figure 8:
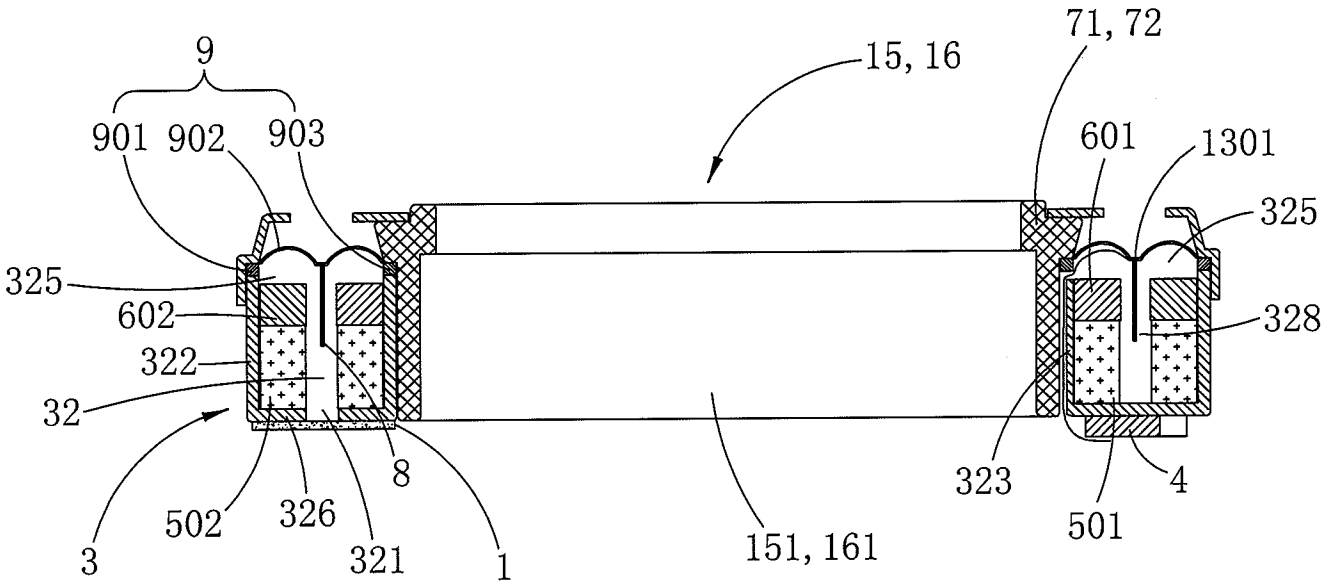
FIG. 8 is a single vocal coil bass sound unit of the audio speaker according to one embodiment of the present disclosure.
Figure 9:
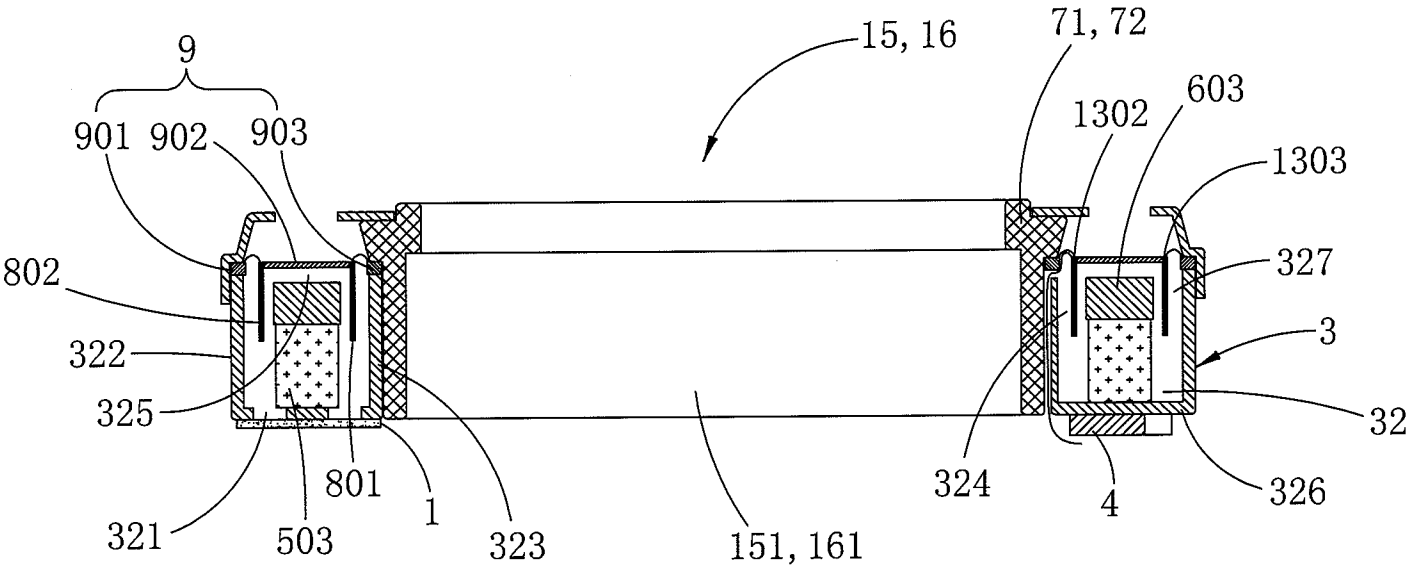
FIG. 9 is a dual vocal coil bass sound unit of the audio speaker according to one embodiment of the present disclosure.

Please refer to FIGS. 5-7. The embodiments in the above figures may differ from the embodiments in previous figures in the presence of the magnetic resistant ring. Specifically, the position where the first bass sound unit 15 and the second bass sound unit 16 connect may be with a first magnetic resistant ring 71 disposed. Similarly, the position where the first bass sound unit 15 and the treble sound unit 2 connect may be with a second magnetic resistant ring 72 disposed. Both the first magnetic resistant ring 71 and the second magnetic resistant ring 72 may be implemented in form of a column structure. Thus, the first magnetic resistant ring 71 may be penetrated by the first bass sound unit 15, which may be positioned within the first magnetic resistant ring 71. And the first magnetic resistant ring 71 may be positioned within the positional space 161 of the second bass sound unit 16. Consequently, the first magnetic resistant ring 71 may be used to separate magnetic fields from the first bass sound unit 15 and the second bass sound unit 16. The treble sound unit 2 may penetrate the second magnetic resistant ring 72 and be positioned therein. The second magnetic resistant ring 72 may be positioned within the positional space 151 of the first bass sound unit 15. Therefore, the second magnetic resistant ring 72 may separate the magnetic fields from the first bass sound unit 15 and the treble sound unit 2.

Please refer to FIGS. 1-3, 5-7, and 8 illustrating a single vocal coil-based sound unit as the first bass sound unit 15 or the second bass sound unit 16. The first bass sound unit 15 or the second bass sound unit 16 may include a magnetic-conductive base 3. A center portion of the magnetic-conductive base 3 may have a hollow positional space 151 or 161. A main body of the magnetic-conductive base 3 may be with an accommodating space 32 having a top opening 325. The top opening 325 may be defined by an outer ring wall 322 and an inner ring wall 323. Away from the top opening 325 may have a bottom surface 326 defined. A vent hole 321 may be disposed on the bottom surface 326.

A first ring-shaped magnet 501 and a second ring-shaped magnet 502 may be positioned within the accommodating space 32. The width and height of the cross-section of the first ring-shaped magnet 501 and the second ring-shaped magnet 502 may be less than the width and height of the cross-section of the accommodating space 32 despite the size of the first ring-shaped magnet 501 is smaller than that of the second ring-shaped magnet 502. The bottom surfaces of the first ring-shaped magnet 501 and the second ring-shaped magnet 502 may be positioned on the bottom surface 326 of the accommodating space 32. The first ring-shaped magnet 501 may be adhered to the inner ring wall 323 while the second ring-shaped magnet 502 may be adhered to the outer ring wall 322. As such, a magnetic gap 328 may be formed between the first ring-shaped magnet 501 and the second ring-shaped magnet 502.

A first ring-shaped magnetic conductive ring 601 may be adhered to a top surface of the first ring-shaped magnet 501 while a second ring-shaped magnetic conductive ring 602 may be adhered to a top surface of the second ring-shaped magnet 502. Thus, the first ring-shaped magnetic conductive ring 601, the first ring-shaped magnet 501, the second ring-shaped magnetic conductive ring 602, and the second ring-shaped magnet 502 may be positioned within the accommodating space 32, with the first ring-shaped magnetic conductive ring 601 and the second ring-shaped conductive ring 602 not extending out of the top opening 325.

The top opening 325 may be integrated with a vibrating vocal tone diaphragm 9. The vibrating vocal tone diaphragm 9 may be composed by a ring-shaped external pressurized frame 901, a diaphragm membrane 902, and a ring-shaped internal pressurized frame 903. The diaphragm membrane 902 may be with an outer ring edge and an inner ring edge. The inner ring edge may be where the ring-shaped inner pressurized frame 903 is positioned while the outer ring edge may be where the ring-shaped external pressurized frame 901 is positioned. A vocal coil 8 may be connected to the diaphragm membrane 902 and between the external pressurized frame 901 and the internal pressurized frame 903. The position where the vocal coil 8 connects to the diaphragm membrane 902 may be where a bass vibration audio source point 1301 is formed. As the external pressurized frame 901 and the internal pressurized frame 903 may be attached to the outer ring wall 322 and the inner ring wall 323, respectively, the vocal coil 8 may be positioned within the accommodating space 32 and within the magnetic gap 328 between the first ring-shaped magnet 501 and the second ring-shaped magnet 502. The vibrating vocal tone diaphragm 9 may therefore enclose the top opening 325.

Please refer to FIGS. 1-3, 5-7, and 9 illustrating a dual vocal coil-based sound unit as the first bass sound unit 15 or the second bass sound unit 16. The first bass sound unit 15 or the second bass sound unit 16 may be with a dual magnetic gap mechanism. Specifically, the first bass sound unit 15 or the second bass sound unit 16 may include a ring-shaped magnetic-conductive base 3. A center portion of the magnetic-conductive base 3 may have a hollow positional space 151 or 161 defined. A main body of the magnetic-conductive base 3 may be with an accommodating space 32 having a top opening 325. The top opening 325 may be defined by an outer ring wall 322 and an inner ring wall 323. Away from the top opening 325 may have a bottom surface 326 defined. A vent hole 321 may be disposed on the bottom surface 326.

A ring-shaped magnet 503 may be positioned within the accommodating space 32. One surface of the ring-shaped magnet 503 may be fixed to the bottom surface 326 of the accommodating space 32 while the other surface of the ring-shaped magnet 503 may have a ring-shaped magnetic conductive ring adhered. The ring-shaped magnet 503 and the ring-shaped magnetic conductive ring 603 may be placed within the accommodating space 32. The ring-shaped magnetic conductive ring 603 may not protrude from the top opening 325. The width and height of the cross-section of the ring-shaped magnet 503 may be less than the width and height of the cross-section of the accommodating space 32. The presence of the ring-shaped magnet 503 may divide the accommodating space 32 into a first magnetic gap 324 and a second magnetic gap 327. The top opening 325 may be integrated with a vibrating vocal tone diaphragm 9. The vibrating vocal tone diaphragm 9 may be composed by a ring-shaped external pressurized frame 901, a diaphragm membrane 902, and a ring-shaped internal pressurized frame 903. The diaphragm membrane 902 may be with an outer ring edge and an inner ring edge. The inner ring edge may be where the ring-shaped inner pressurized frame 903 is positioned while the outer ring edge may be where the ring-shaped external pressurized frame 901 is positioned. A first vocal coil 801 may be connected to the diaphragm membrane 902 in the proximity of the inner ring edge and a second vocal coil 802 may be connected to the diaphragm membrane 902 in the proximity of the outer ring edge. Therefore, one inner ring vocal coil (the first vocal coil 801) and one outer ring vocal coil (the second vocal coil 802) may be formed for the diaphragm membrane 902. The position where the first vocal coil 801 connects to the diaphragm membrane 902 may be where a first bass vibration audio source point 1302 is formed. And the position where the second vocal coil 802 connects to the diaphragm membrane 902 may be where a second bass vibration audio source point 1303 is formed. As the external pressurized frame 901 and the internal pressurized frame 903 may be attached to the outer ring wall 322 and the inner ring wall 323, respectively, the first vocal coil 801 may be positioned within the first magnetic gap 324 and the second vocal coil 802 may be positioned within the second magnetic gap 327. As the result, the ring-shaped magnet 503 may be positioned between the first vocal coil 801 and the second vocal coil 802. The vibrating vocal tone diaphragm 9 may therefore enclose the top opening 325.

Figure 10:
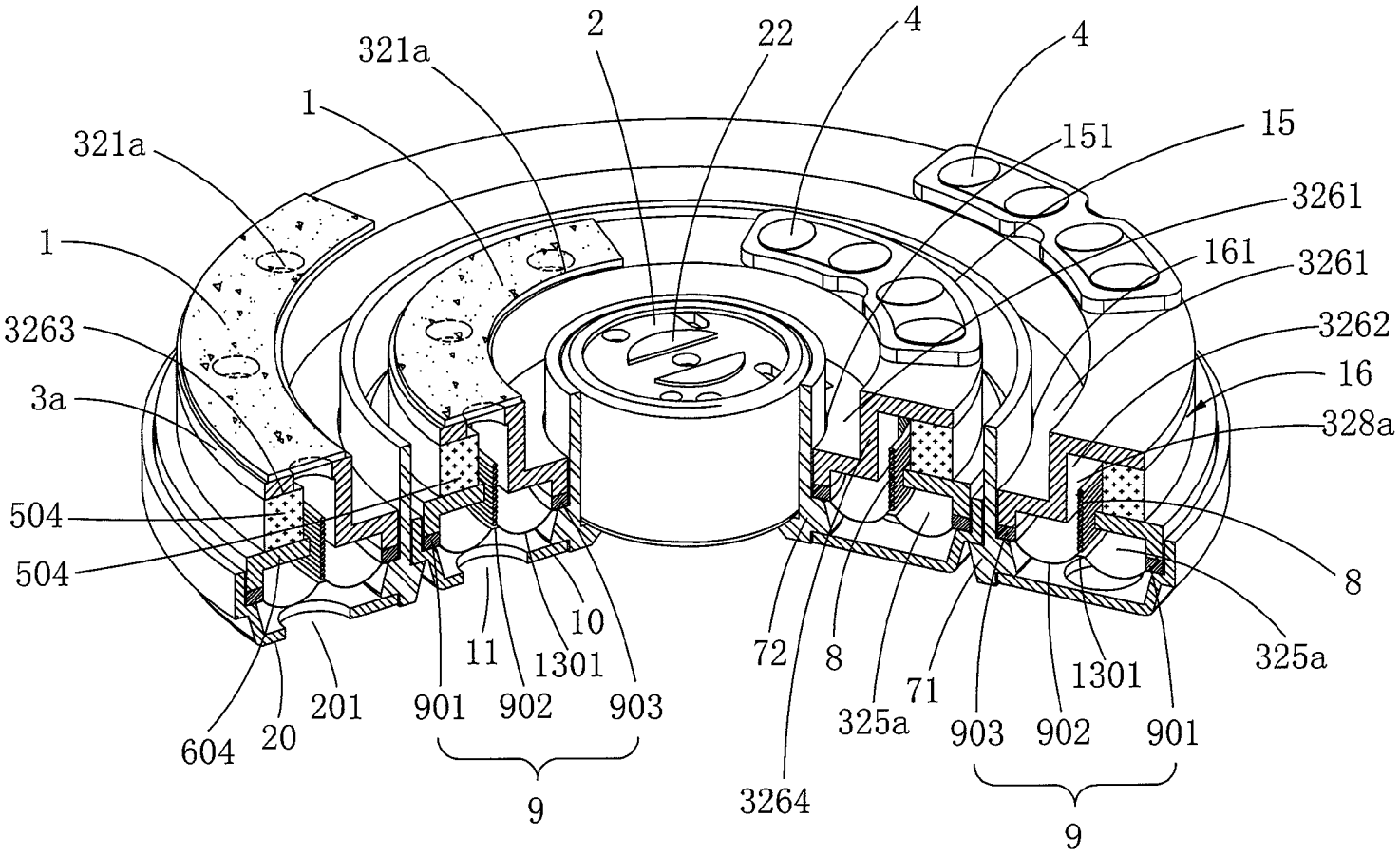
FIG. 10 shows another single vocal coil bass sound unit of the audio speaker according to one embodiment of the present disclosure.

Please refer to FIG. 10 illustrating the cross sectional of a magnetic conductive base 3*a* of either the first bass sound unit or the second bass sound unit 16 being Z-shaped. The first bass sound unit 15 or the second bass sound unit 16 may be a single magnetic gap mechanism. The position where the first bass sound unit 15 and the second bass sound unit 16 connect may be where a first magnetic resistant ring 71 is placed. The first magnetic resistant ring 71 may separate the magnetic fields from the first bass sound unit 15 and the second bass sound unit 16. The first bass sound unit 15 and the second bass sound unit 16 may be co-axially disposed. The position where the first bass sound unit 15 and the treble sound unit 2 connect may be where a second magnetic resistant ring 72 is disposed. The second magnetic resistant ring 72 may separate the magnetic fields from the first bass sound unit 15 and the treble sound unit 2. The first bass sound unit 15 and the treble sound unit 2 may be co-axially disposed as well, though the first bass sound unit 15 may surround the treble sound unit 2. The ring-shaped magnetic-conductive base 3*a* may have at its center portion the hollow positional space 151 or 161. A main body of the magnetic-conductive base 3*a* may be an auxiliary magnet adjoining space 3261 and a coil movement space 3262 adjacent to the auxiliary magnet adjoining space 3261. A separating wall 3264 may be placed between the coil movement space 3262 and the auxiliary magnet adjoining space 3261. The cross section of the magnetic-conductive base 3*a* may be Z-shaped. And a vent hole 321*a* may be disposed on an adjoining surface 3263 of the coil movement space 3262. As shown in FIG. 10, the auxiliary magnet adjoining space 3261 is close to the positional space 151 and 161, while the coil movement space 3262 may be away from the positional space 151 and 161.

A ring-shaped magnet 504 may be disposed on the adjoining surface 3263 of the coil movement space 3262. The width and height of the cross section of the ring-shaped magnet 504 may be less than the width and height of the coil movement space 3262. The ring-shaped magnet 51 may be within the coil movement space 3262 and away from the auxiliary magnet adjoining space 3261. Since the width of the ring-shaped magnet 504 is less than the width of the coil movement space 3262, the ring-shaped magnet 504 in no event may entirely fill the coil movement space 3262, maintaining a magnetic gap 328*a* associated with a separating wall 3264 in the proximity of the auxiliary magnet adjoining space 3261.

A ring-shaped magnetic conductive ring 604 may be adhered to a top surface of the ring-shaped magnet 504. Thus, both the ring-shaped magnet 504 and the ring-shaped magnetic conductive ring 604 may be placed within the coil movement space 3262.

A top opening 325*a* may be formed between the magnetic-conductive base 3*a* and the ring-shaped magnetic conductive ring 604. The top opening 325*a* may be integrated with a vibrating vocal tone diaphragm 9. The vibrating vocal tone diaphragm 9 may be composed by a ring-shaped external pressurized frame 901, a diaphragm membrane 902, and a ring-shaped internal pressurized frame 903. The diaphragm membrane 902 may be with an outer ring edge and an inner ring edge. The inner ring edge may be where the ring-shaped inner pressurized frame 903 is positioned while the outer ring edge may be where the ring-shaped external pressurized frame 901 is positioned. A vocal coil 8 may be connected to the diaphragm membrane 902 and between the external pressurized frame 901 and the internal pressurized frame 903. The position where the vocal coil 8 connects to the diaphragm membrane 902 may be where a bass vibration audio source point 1301 is formed. As the external pressurized frame 901 and the internal pressurized frame 903 may be attached to an outer edge 322 and an inner edge ring 323, respectively, the vocal coil 8 may be positioned within the coil movement space 3262 and the magnetic gap 328*a* between the separating wall 3264 and the ring-shaped magnet 504. The vibrating vocal tone diaphragm 9 may therefore enclose the top opening 325*a*.

The magnetic field provided by the ring-shaped magnet 504 may be conductive present the ring-shaped magnetic conductive ring 604 along with the vocal coil 8 and the magnetic-conductive base 3*a* further serving to render conductive the magnetic field. A vent hole 321*a* may allow for the air associated with the vibration of the vibrating vocal tone diaphragm 9 to be channeled out. It is worth noting that another side of the magnet 504 may extend out of the coil movement space 3262, enhancing the magnetic force of the magnetic gap.

Figure 11:
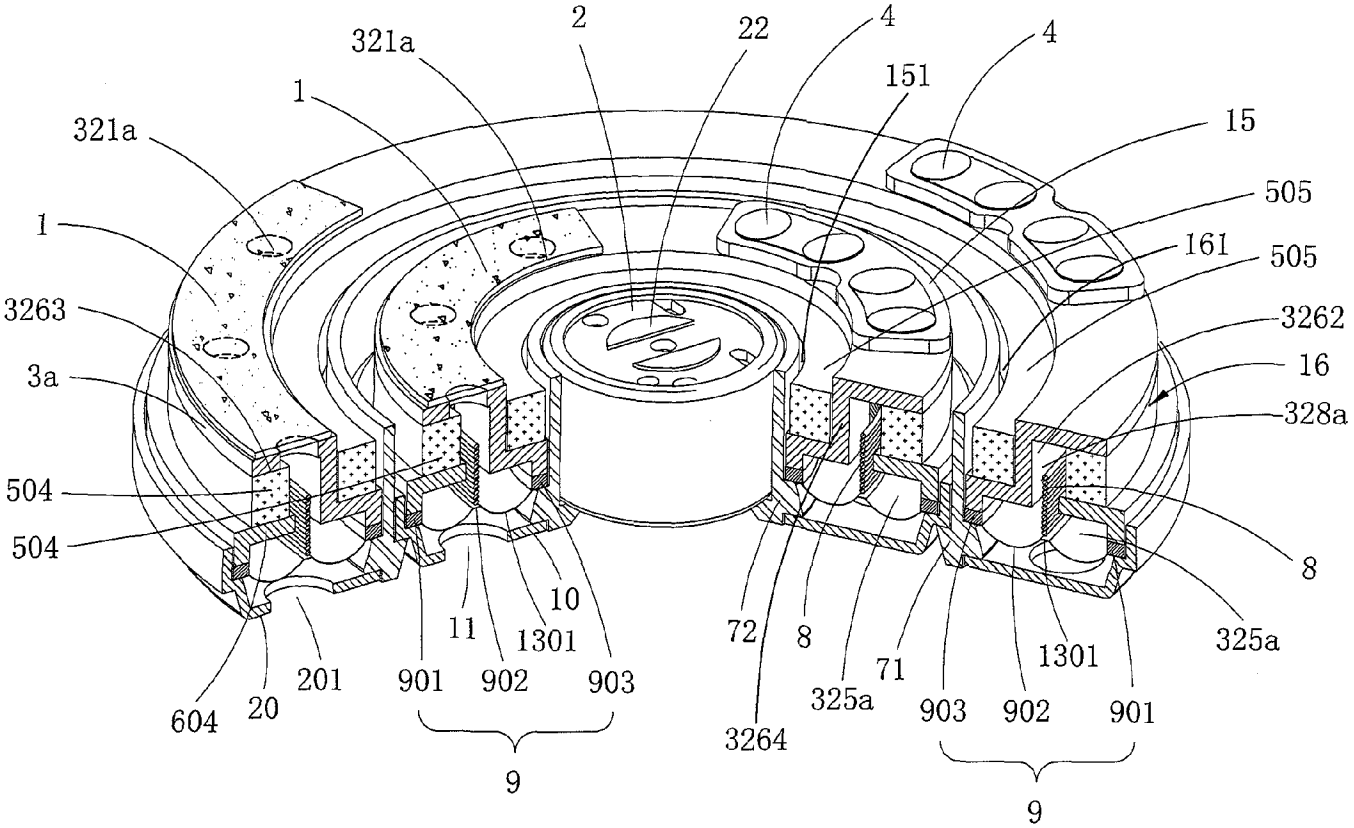
FIG. 11 shows another single vocal coil bass sound unit of the audio speaker according to one embodiment of the present disclosure.

Please refer to FIG. 11 showing another audio speaker according to another embodiment of the present disclosure. The auxiliary magnetic adjoining space 3261 may be where an auxiliary magnet 505 is stationed. The size of the auxiliary magnet 505 may be smaller than that of the ring-shaped magnet 504, and the cross-sectional width and height of the auxiliary magnet 505 may be less than the cross-sectional width and height of the coil movement space 3262. With the auxiliary magnet 504 and the magnetic-conductive base 3*a*, which could conduct the magnetic fields, the overall magnetricity may increase.

Figure 12:
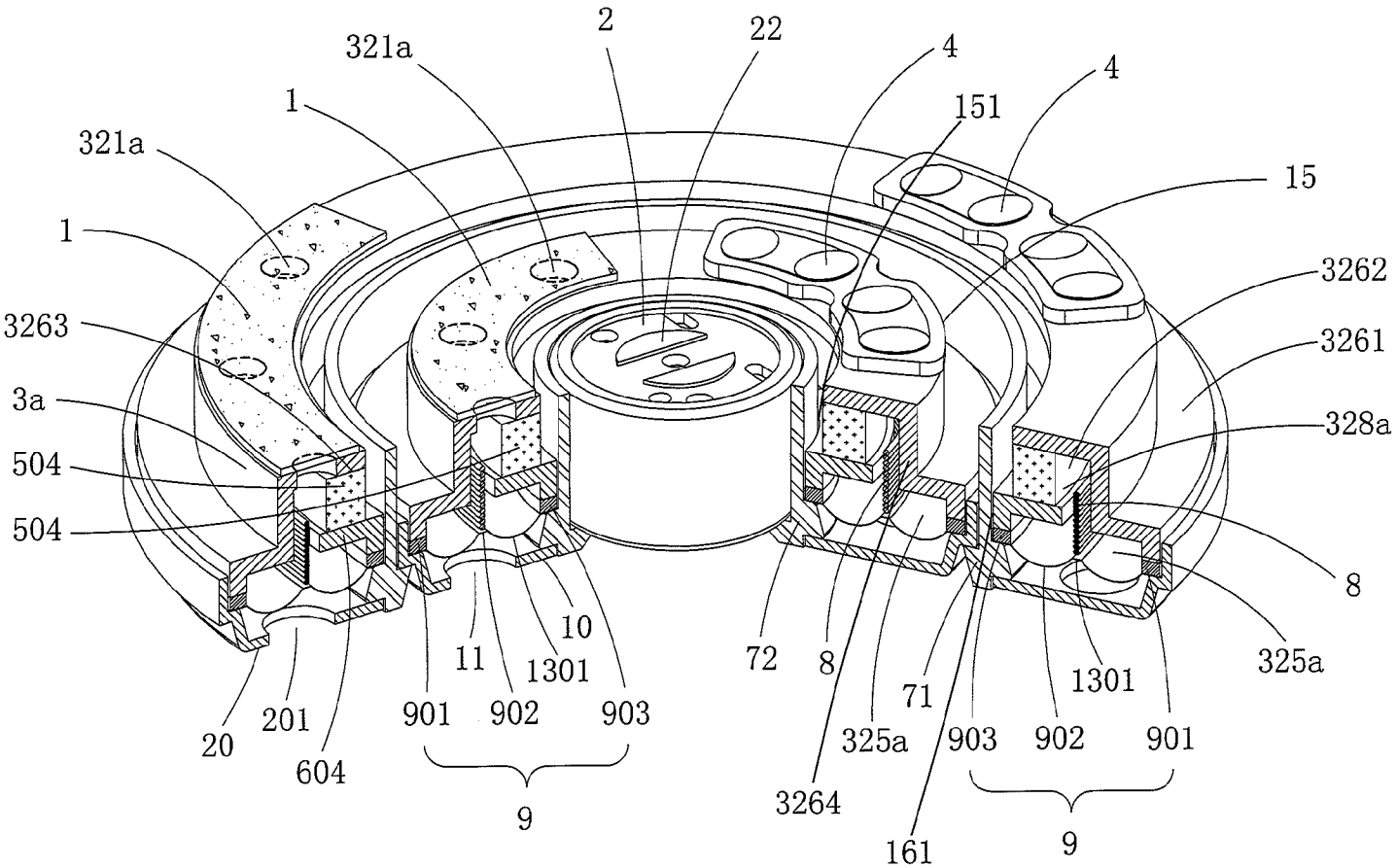
FIG. 12 shows another single vocal coil bass sound unit of the audio speaker according to one embodiment of the present disclosure.

Please refer to FIG. 12. The embodiment in FIG. 12 may differ from the embodiment in FIG. 10 in the placement of both the coil movement space 3262 and the auxiliary magnetic adjoining space 3261. Specifically, in the embodiment shown in FIG. 12 the coil movement space 3262 may be in the proximity of the positional space 151 and 161 while the auxiliary magnetic adjoining space 3261 may be away from the positional space 151 and 161. Accordingly, the cross section of the magnetic-conductive base embodiment in FIG. 12 may be opposite in shape with respect to the cross section of the magnetic-conductive base in the embodiment in FIG. 11.

Figure 13:
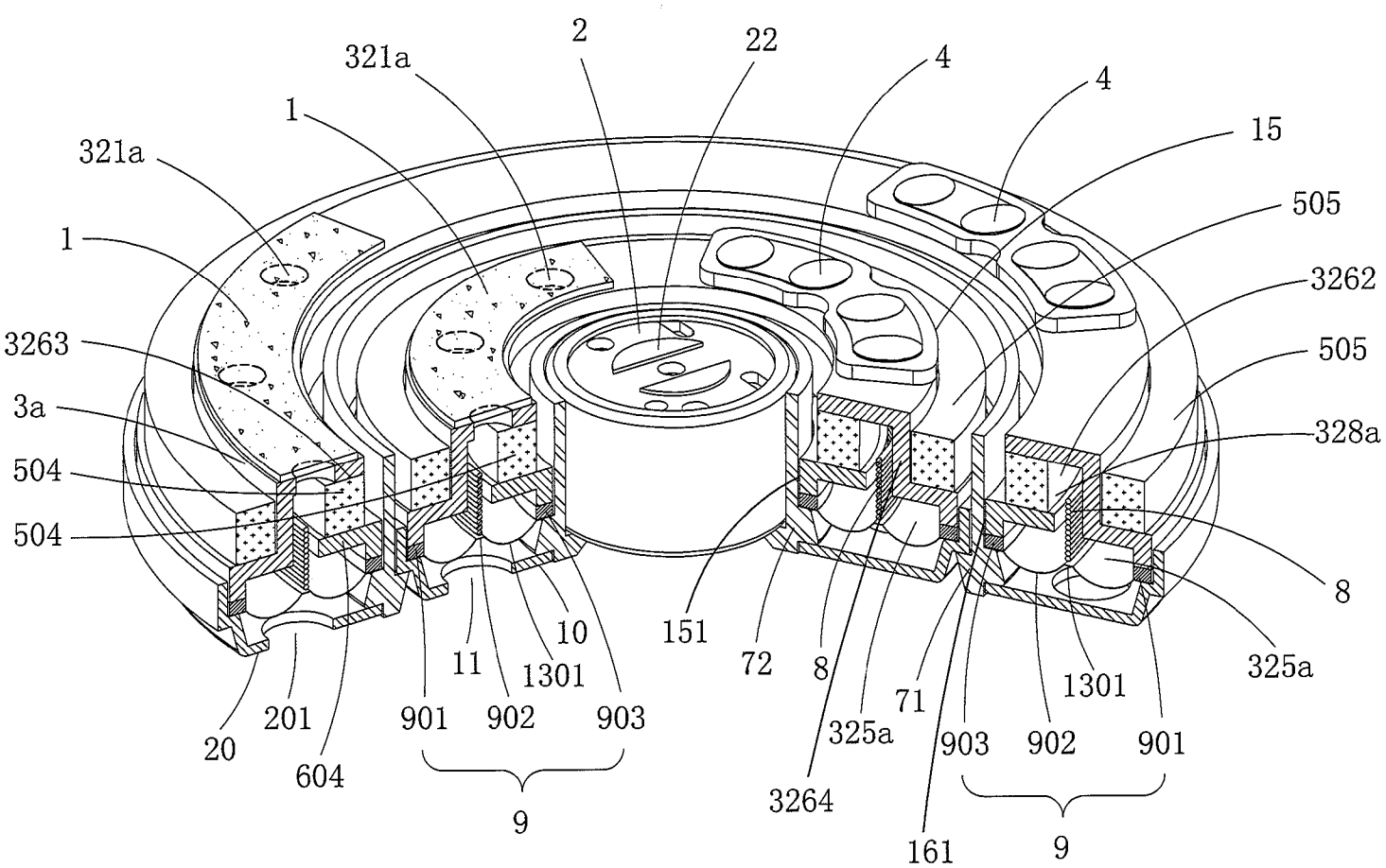
FIG. 13 shows another single vocal coil bass sound unit of the audio speaker according to one embodiment of the present disclosure.

Meanwhile, as shown in FIG. 13, despite the auxiliary magnet 505 may be disposed within the auxiliary magnetic adjoining space 3261 that is away from the positional space 151 and 161, this particular embodiment may function similarly to its counterpart in FIG. 11.

The diaphragm membranes 902 in the first bass sound unit 15 and the second bass sound unit 16 may be a composite diaphragm material. And the diaphragm membrane material may be polymer plastic, plastic polymer fibers, organic fibers, mineral matters or the like and in the form of a thin film. In another implementation, the diaphragm membrane 902 may be formed by braided-type punching and forming. The mineral matters may include metals, rocks, minerals, glasses, or combinations of the above. The external pressurized frame 901 or the internal pressurized frame 903 may not be ring-shaped. In other words, the external pressurized frame 901 or the internal pressurized frame 903 may be oval, triangular, rectangular, polygonal, or in other shape.

Wiring boards 4 may be adhesively attached to external walls of the bottom surface of the magnetic-conductive bases 3 and 3*a*. The wiring boards 4 may allow for wires of the vocal coils 8, 801, and 802 to be positioned.

The coupling between the treble sound unit 2 may be positioned within the positional space 151 of the first bass sound unit 15 by adhesion, engaging, or other commercially available connecting approaches. The first bass sound unit 100 may co-axially surround the treble sound unit 2. The first bass sound unit 15 may couple to the second bass sound unit 16 by adhesion, engaging, or other commercially available connecting approaches as well. The second bass sound unit 16 may co-axially surround the first bass sound unit 15. The bass vibration audio source points 1301-1303 of the first bass sound unit 15 and the bass vibration audio source points 1301-1303 of the second bass sound unit 16 may be at the same horizontal level with the treble vibration audio source point 21 of the treble sound unit 2. Thus, the audio speaker according to the present disclosure may be with a broader range of electrical adjustability even with one single audio source.

The wiring board 22 of the magnetized treble sound unit 2 and the wiring boards 4 of the magnetized first bass sound unit 15 and the magnetized second bass sound unit 16 may be connected to electrical signal wires.

The external surface of the bottom surface of the magnetic-conductive base 3 may be having flow damping gauze 1 adhesively attached. The flow damping gauze 1 may cover the vent holes 321 and 321*a* and may be for adjusting the air flow within the accommodating space 32 and the coil movement space 3262.

Above the first bass sound unit 15 may overlay a first dust cover 10. And a second dust cover 20 may overlay the second bass sound unit 16. A first bass sound hole 11 may be disposed on the first dust cover 10 and allow for the sound from the first bass sound unit 15 to be channeled through the first bass sound hole 11 of the first dust cover 10. Similarly, the sound from the second bass sound unit 16 may be channeled out of the second bass sound unit through a second bass sound hole 201 of the second dust cover 20. Meanwhile, the sound from the treble sound hole 2 may be channeled out of the treble sound unit 2 through the treble sound hole 12.

The embodiments discussed in above may be applicable in a variety of different audio speakers or earphones. The earphones, for instance, may include in-ear headphones, ear canal headphones, back neck earphones, and headphones.

Some modifications of these examples, as well as other possibilities will, on reading or having read this description, or having comprehended these examples, will occur to those skilled in the art. Such modifications and variations are comprehended within this disclosure as described here and claimed below. The description above illustrates only a relative few specific embodiments and examples of the present disclosure. The present disclosure, indeed, does include various modifications and variations made to the structures and operations described herein, which still fall within the scope of the present disclosure as defined in the following claims.

What is claimed is:

1. A coaxial audio speaker comprising:

a treble sound unit with a treble vibration audio source point and a treble wiring board;

a first bass sound unit having a first positional space, a first vibrating vocal tone diaphragm, and a first bass wiring board, and the first bass sound unit being associated with a first bass vibration audio source point; and a second bass sound unit having a second positional space, a second vibrating vocal tone diaphragm, and a second bass wiring board, and the second bass sound unit associated with a second bass vibration audio source point;

wherein the first bass sound unit is co-axially disposed with the second bass sound unit and positioned within the second positional space, and the treble sound unit is co-axially disposed with the first bass sound unit and positioned within the first positional space;

wherein the first bass sound unit, the second bass sound unit, and the treble sound unit are co-axially disposed and the first bass vibration audio source point, the second bass vibration audio source point, and the treble vibration audio source point are at the same horizontal level.

2. The audio speaker according to claim 1, wherein the treble sound unit is a circular electromagnetic sound unit, a rectangular electromagnetic moving iron sound unit, a moving-vocal coil sound unit, a ribbon-type sound unit, a piezo-ceramic sound piece component, a piezo-ceramic sound piece adjoining another vibrating vocal tone diaphragm, or a semiconductor chip sound unit.

3. The audio speaker according to claim 1, further comprising a first magnetic resistant ring disposed at the position where the co-axially disposed first bass sound unit and the second bass sound unit adjoin, for separating a magnetic field of the first bass sound unit and a magnetic field of the second bass sound unit.

4. The audio speaker according to claim 1, further comprising a second magnetic resistant ring disposed at the position where the co-axially disposed first bass sound unit and the treble sound unit adjoin, for separating a magnetic field of the first bass sound unit and a magnetic field of the treble sound unit.

5. The audio speaker according to claim 1, wherein the first bass sound unit or the second bass sound unit further comprises:

a ring-shaped magnetic-conductive base with a center portion of the magnetic-conductive base defining a hollow positional space, and a main body of the ring-shaped magnetic-conductive base defining an accommodating space with a top opening, wherein the main body includes an inner ring wall and an outer ring wall defining the top opening;

a first ring-shaped magnet and a second ring-shaped magnet, the first ring-shaped magnet positioned and attached at the inner ring wall, the second ring-shaped magnet positioned and attached at the outer ring wall, and the first ring-shaped magnet and the second ring-shaped magnet defining a magnetic gap therebetween;

a first magnetic-conductive ring and a second magnetic-conductive ring, the first magnetic-conductive ring disposed on a top surface of the first ring-shaped magnet, and the second magnetic-conductive ring disposed on a top surface of the second ring-shaped magnet;

a vibrating vocal tone diaphragm having a ring-shaped diaphragm membrane, an external pressurized frame positioned at an outer ring edge of the ring-shaped diaphragm membrane and connected to an end of the outer ring wall of the ring-shaped magnetic conductive base, and an internal pressurized frame positioned at an inner ring edge of the ring-shaped diaphragm membrane and connected to an end of the inner ring wall of the ring-shaped magnetic conductive base, the ring-shaped magnetic conductive base enclosed at the top opening as the result, a vocal coil connected to a bottom of the ring-shaped diaphragm membrane, a position where the vocal coil and the diaphragm membrane connect defining a vibration audio source point, and the vocal coil extending into the magnetic gap; and a wiring board adjoined on an external wall of a bottom surface of the magnetic-conductive base for positioning wires of the vocal coil.

6. The audio speaker according to claim 5, further comprising a flow damping gauze adhesively attached on the external wall of the bottom surface of the magnetic-conductive base for covering a vent hole and adjusting an air flow within the positional space, a first dust cover above the first bass sound unit and the treble sound unit allowing for the sound of the first bass sound unit to be transmitted out of a first bass sound hole of the first dust cover, and a second dust cover above the second bass sound unit allowing for the sound of the second bass sound unit to be transmitted out of a second sound hole of the second dust cover, with the treble sound unit associated with a treble sound hole allowing for the sound from the treble sound unit to be transmitted out of the treble sound hole.

7. The audio speaker according to claim 1, wherein the first bass sound unit or the second bass sound unit further comprises:

a ring-shaped magnetic-conductive base with a center portion of the magnetic-conductive base defining a hollow positional space, and a main body of the ring-shaped magnetic-conductive base defining an accommodating space with a top opening, wherein the main body includes an inner ring wall and an outer ring wall defining the top opening;

a ring-shaped magnet positioned and attached at the inner ring wall, the second ring-shaped magnet positioned between the outer ring wall and the inner ring wall, defining the positional space into a first magnetic gap and a second magnetic gap;

a magnetic-conductive ring disposed on a top surface of the ring-shaped magnet;

a vibrating vocal tone diaphragm having a ring-shaped diaphragm membrane, an external pressurized frame positioned at an outer ring edge of the ring-shaped diaphragm membrane and connected to an end of the outer ring wall of the ring-shaped magnetic conductive base, and an internal pressurized frame positioned at an inner ring edge of the ring-shaped diaphragm membrane and connected to an end of the inner ring wall of the ring-shaped magnetic conductive base, a first vocal coil connected to the inner ring edge, a first vibration audio source point formed at the position where the first vocal coil and the inner ring edge connect, a second vocal coil connected to the outer ring edge, a second vibration audio source point formed at the position where the second vocal coil and the outer ring edge connect, the vibrating vocal tone diaphragm integrated and stationed around the top opening of the ring-shaped magnetic conductive base, the diaphragm membrane positioned at the top opening of the positional space and enclosing the top opening, the first vocal coil extending into the first magnetic gap, and the second vocal coil extending into the second magnetic gap, for the magnet to be positioned between the first vocal coil and the second vocal coil;

a wiring board adjoined on an external wall of a bottom surface of the magnetic-conductive base for positioning wires of the first vocal coil and the second vocal coil.

8. The audio speaker according to claim 7, further comprising a flow damping gauze adhesively attached on the external wall of the bottom surface of the magnetic-conductive base for covering a vent hole and adjusting an air flow within the positional space, a first dust cover above the first bass sound unit and the treble sound unit allowing for the sound of the first bass sound unit to be transmitted out of a first bass sound hole of the first dust cover, and a second dust cover above the second bass sound unit allowing for the sound of the second bass sound unit to be transmitted out of a second sound hole of the second dust cover, with the treble sound unit associated with a treble sound hole allowing for the sound from the treble sound unit to be transmitted out of the treble sound hole.

9. The audio speaker according to claim 1, wherein the first bass sound unit or the second bass sound unit further comprises:

a ring-shaped magnetic-conductive base with a center portion of the magnetic-conductive base defining a hollow positional space, and a main body of the ring-shaped magnetic-conductive base having an auxiliary magnetic adjoining space and a coil movement space separated from the auxiliary magnetic adjoining space by a separating wall;

a ring-shaped magnet having a first surface and a second surface opposite to the first surface, either the first surface or the second surface located within the coil movement space, and the ring-shaped magnet positioned within the coil movement space and away from the separating wall, to form a magnetic gap between the ring-shaped magnet and the separating wall;

a magnetic-conductive ring disposed on either the first surface or the second surface not within the coil movement space, defining a top opening between the ring-shaped magnetic ring and the magnetic-conductive base;

a vibrating vocal tone diaphragm having a ring-shaped diaphragm membrane on which a vocal coil is connected, the position where the vocal coil and the diaphragm membrane connect forming a bass vibration audio source point, the vibrating vocal tone diaphragm positioned around the top opening defined by the magnetic-conductive base and the magnetic-conductive ring to enclose the top opening, and the vocal coil extending into the coil movement space and positioned within the magnetic gap within the coil movement space; and a wiring board adjoined on an external wall of a bottom surface of the magnetic-conductive base for positioning wires of the vocal coil.

10. The audio speaker according to claim 9, wherein the auxiliary magnetic adjoining space is in the proximity of the positional space while the coil movement space is away from positional space.

11. The audio speaker according to claim 10, wherein an auxiliary magnet is within the auxiliary magnetic adjoining space.

12. The audio speaker according to claim 9, wherein the coil movement space is in the proximity of the positional space while the auxiliary magnetic adjoining space is away from positional space.

13. The audio speaker according to claim 12, wherein an auxiliary magnet is within the auxiliary magnetic adjoining space.

14. The audio speaker according to claim 9, further comprising a flow damping gauze adhesively attached on the external wall of the bottom surface of the magnetic-conductive base for covering a vent hole and adjusting an air flow within the positional space, a first dust cover above the first bass sound unit and the treble sound unit allowing for the sound of the first bass sound unit to be transmitted out of a first bass sound hole of the first dust cover, and a second dust cover above the second bass sound unit allowing for the sound of the second bass sound unit to be transmitted out of a second sound hole of the second dust cover, with the treble sound unit associated with a treble sound hole allowing for the sound from the treble sound unit to be transmitted out of the treble sound hole.

* * * * *